US008286380B2

(12) United States Patent
Pitcher et al.

(10) Patent No.: US 8,286,380 B2
(45) Date of Patent: Oct. 16, 2012

(54) ABUTTABLE SNAP FRAME GRAPHIC DISPLAY ARRANGEMENT

(75) Inventors: David E. Pitcher, Swampscott, MA (US); Rebecca C. Suciu, Lynn, MA (US); Thomas P. Burrous, Haverhill, MA (US); Paul P. Ellsworth, Burlington, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 99 days.

(21) Appl. No.: 12/924,064

(22) Filed: Sep. 20, 2010

(65) Prior Publication Data

US 2012/0066949 A1 Mar. 22, 2012

(51) Int. Cl.
*A47G 1/06* (2006.01)

(52) U.S. Cl. ..... 40/792; 40/791; 40/729

(58) Field of Classification Search ..... 40/661.03, 40/729, 792, 793, 794, 735; 24/487, 499
See application file for complete search history.

(56) References Cited

U.S. PATENT DOCUMENTS

| | | | | | |
|---|---|---|---|---|---|
| 1,315,196 | A * | 9/1919 | Moorehous | 40/793 |
| 3,991,960 | A * | 11/1976 | Tanaka | 248/68.1 |
| 4,523,400 | A * | 6/1985 | Seely | 40/791 |
| 4,524,992 | A * | 6/1985 | Linn | 281/45 |
| 5,172,504 | A * | 12/1992 | De Maat et al. | 40/605 |
| 6,061,882 | A * | 5/2000 | Otte-Wiese | 24/487 |
| 2001/0042331 | A1 * | 11/2001 | Ostrovsky | 40/793 |
| 2009/0133306 | A1 * | 5/2009 | Pitcher et al. | 40/793 |

* cited by examiner

*Primary Examiner* — Tashiana Adams
*Assistant Examiner* — Christopher E Veraa
(74) *Attorney, Agent, or Firm* — Don Halgren

(57) ABSTRACT

An elongated abuttable snap frame arrangement for biasably, removably, capturing a display graphic support and for display thereof, the arrangement comprising: an elongated base panel, an elongated cover that is flexibly attached to the base panel at its upper edge, and an elongated hinge member flexibly attached to the elongated base panel and the elongated cover, the cover able to rotate from a parallel closed position to a generally perpendicular open position without interfering with adjacent objects or other abutting snap frame arrangements.

19 Claims, 4 Drawing Sheets

ABUTTABLE SNAP FRAME GRAPHIC DISPLAY ARRANGEMENT

BACKGROUND OF THE INVENTION

1. Field of the Invention

This invention relates to frame members, and in particular, a frame assembly thereof, that utilizes multiple hinge points to provide a range of motion between open and closed positions and apply a bias on a graphic.

2. Discussion of Prior Art

Front loading graphic display frames have been utilized by the merchandising industry for many years. Those frames comprise rails which are assembled around a backer board or a graphic sheet which may be as thick as a backboard. Patents on such frames may be seen for example U.S. Pat. Nos. 4,512,094; 4,512,095 or 4,523,400. As an example of that prior art, their limitations include difficulty in the attachment of the elongated rails to the backer board during assembly. Other concerns of the prior art include limitations in which the graphic sheet and backer board have to be a particular thickness. In other words, there is a particular defined space in the frame rail which limits the graphic sheet and/or backer board to one thickness, and it cannot be thinner or thicker.

Front loading graphic display frames also have a problem that multiple frames cannot be permanently attached where the corner edge of their base rails are adjacent to one another in a touching relationship, or their covers would interfere with the adjacent frame or structure. When these graphic frame assemblies open, such as shown for example in U.S. Pat. No. 7,654,026, the covers extend beyond the back edge of their elongated base. This needed space requirement prevents such a pivoting graphic display frame from being able to be abutted directly against an adjacent graphic display frame or directly against a fixture of some sort.

It is an object of the present invention to overcome the disadvantages of the prior art.

It is a further object of the present invention to provide an extruded frame rail which may receive a display by the opening of a cover thereof, without that cover portion pivoting too far over and interfering with or being interfered with, by an adjacent fixture or further extruded frame rail.

BRIEF SUMMARY OF THE INVENTION

The present invention comprises a space saving snap frame assembly comprised of multiple abuttable space saving snap frame members. Each abuttable frame member comprises an elongated extrusion having an elongated base panel thereon. A thin layer of securement material such as adhesive may be applied to an upper and/or a lower side of the base panel during the extrusion operation. The elongated base panel includes an elongated distal edge along one side thereof. The elongated base panel includes a first flange along an elongated proximal edge thereof. An elongated first stationary wall extends at a right angle from the upper side of the elongated base panel and a close spaced-apart distance from the elongated first flange. A bridging member extends from a midpoint of the first stationary wall rearwardly, to a second stationary wall. The second stationary wall is "L" shaped in cross-section, and has a forwardly directed second flange thereon. The first flange and the second flange lie in a common plane and are spaced apart so as to define a gap therebetween. An open channel is thus defined between the first flange, the second flange, and the bridging member extending between the first wall and the second wall. The second wall has an elongated upper edge which is unitary with a "J" shaped elongated cover. The second wall and the elongated "J" shaped cover are unitarily attached to one another by a first elongated web of flexible material. The location of this elongated web of flexible material permits abuttable frame members to be placed next to one another or to fixed objects without the need for leaving any space between them.

The first wall has an elongated upper edge which is attached unitarily to the lower side of an elongated first hinge leg. The elongated "J" shaped cover has a second leg extending perpendicularly inwardly therefrom, adjacent to the location of the first web of flexible material. The elongated distalmost edge of the second leg is flexibly connected to the uppermost elongation edge of the first hinge leg by a commonly extruded flexible web of material unitarily arranged therebetween.

The elongated "J" shaped cover has an elongated distalmost edge which has an elongated distal leg extending there from. The distal leg has an elongated distalmost edge of preferably soft gripping material coextruded therewith.

The elongated "J" shaped cover, when it is in its open and "display receiving" orientation is in generally vertical (parallel) (common plane) alignment with the second wall of the frame member, the second wall extending perpendicularly away from the plane of the base panel at the proximalmost or rear edge thereof. In other words, the cover does not open or rotate beyond the plane of the second wall.

The backer board is attached to a layer of securement material on the upper surface of the base panel, thus providing a surface for supporting a planar display.

When it is desired to retain some sort of planar display onto the upper side of the backer board panel, the elongated "J" shaped cover is manually caused to pivot downwardly, so as to effect the elongated distalmost edge thereon into biased contact with that display member. During that pivoting motion of the "J" shaped cover down radially, it pivots about its first web of flexible material, which material extends between the elongated edges of the "J" shaped cover and the upper edge of the second wall. The second hinge leg thus is pivoted in a clockwise orientation, inasmuch as it is fixedly attached to the inner side of the "J" shaped cover. That second hinge leg, being flexibly connected via an elongated flexible web of material, to the upper elongated edge of the first hinge leg, pivots that first hinge leg counterclockwise about its elongated web of flexible material by which it is attached, to the upper elongated edge of the first wall. Thus, the "J" shaped cover pivots from a generally perpendicular orientation to the base panel, into an orientation which is generally parallel thereto. The second hinge leg, is best pivoted, from a generally horizontal and parallel orientation with respect to the base panel into an orientation which is perpendicular to the base panel. The first hinge leg is pivoted about its elongated flexible web of material to which it is attached to the upper elongated edge of the first wall, by about 90°, so as to reside at an 8 o'clock orientation as opposed to its 11 o'clock orientation.

Thus the elongated intermediate second web of flexible material is snapped into an orientation closer to the bridging member between the first wall and the second wall from a position of being spaced further away. That snapping orientation effects the biasing of the elongated distalmost edge of the "J" shaped cover onto a display panel between that elongated distalmost edge and the base panel or a backer panel thereon.

The elongated open channel between the first flange and the second flange and the bridging member extending between the elongated first wall and the second wall defines a receiving space for an "L" shaped corner bracket so as to permit multiple frame members to be attached at their corners to provide a rectilinear assembly therearound, if desired.

The invention thus comprises an elongated abuttable space-saving snap frame arrangement for biasably, removably, capturing a display graphic for support and display thereof comprising: an elongated extruded base panel; an elongated first wall arranged perpendicular to the base panel; an elongated proximalmost second wall; an elongated cover flexibly attached by an elongated flexible web to an upper edge of the second wall, the elongated cover having an elongated connecting leg extending perpendicularly inwardly therefrom, adjacent the upper edge of the second wall; an elongated first hinge leg flexibly connected by an elongated flexible web, to a distal edge of the elongated leg extending from the elongated cover, the elongated first hinge leg also flexibly connected by an elongated flexible web, to an upper edge of the first wall, where movement of the elongated cover effects rotation of the elongated hinge leg. The elongated second wall and the elongated cover are preferably co-planar when the elongated cover is in a full open orientation. The elongated first wall and the elongated second wall are connected by an elongated bridge member. The elongated first hinge leg is caused to rotate towards the elongated bridge member when the elongated cover is rotated towards the elongated base panel. The elongated first wall has an elongated first flange thereadjacent and the elongated second wall has an elongated first flange thereadjacent, the elongated first and second flanges being spaced apart in a common plane with the elongated base panel. The elongated cover has an elongated "J" shaped distal leg thereon. The elongated "J" shaped distal leg preferably has an elongated, display-engaging, soft distal edge thereon. The elongated first hinge leg pivots away from the elongated second wall when the elongated cover is pivoted upwardly away from the elongated base panel. The elongated base panel may have an elongated layer of adhesive deposited on an upper side thereof. The elongated cover and the elongated base panel are in general parallel alignment when the cover is in its closed orientation. The elongated cover is preferably limited to a non-obstructing, "full-open orientation" pivot of 90 degrees about the elongated flexible web to which it is connected to the elongated second wall. The inwardly extending elongated connecting leg attached to the elongated cover effects a snap bias onto the elongated first hinge leg effecting a snap rotation thereof. The elongated second wall and the elongated cover are arranged to preferably lie generally in the same plane when the elongated cover is in a full open orientation. The elongated cover may also extend beyond the plane of the second wall when the elongated cover is in a full open orientation.

The invention also comprises a method of retaining a display panel within an openable frame member, with the openable frame member being in abuttable contact with a fixture or another abuttable frame member, comprising: extruding an elongated base panel having an upper surface with a first wall extending perpendicularly therefrom, and a second wall connected to and spaced apart from the first wall, the second wall having a rearmost vertical plane; co-extruding a cover so as to be flexibly attached to the second wall by a flexible web, the first wall and the cover being connected to one another by a flexibly attached first leg connected to the first wall and a second leg connected to an inside portion of the cover, the cover in it's openmost "display-receiving" or "display-removal" configuration needing to extend no further than the rearmost vertical plane of the second wall; closing the cover against a display panel by pivoting the cover about the flexible web by which it is attached to the second wall, by rotating the first leg and the second leg in directions counter to one another. The first wall and the second wall are preferably connected by a bridging member extending there between. The first leg is preferably connected to the first wall by a flexible web extending there between, and wherein the first leg is also connected to the second leg by flexible web extending therebetween. The method preferably includes biasing a distal edge of the cover against the display panel during the counter rotation of the first leg with respect to the second leg. The method may also include the step of rotating the first leg between a pair of spaced apart flexible webs so as to effect opening or closing of the cover away from or onto a display panel disposed on the base panel.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 5:
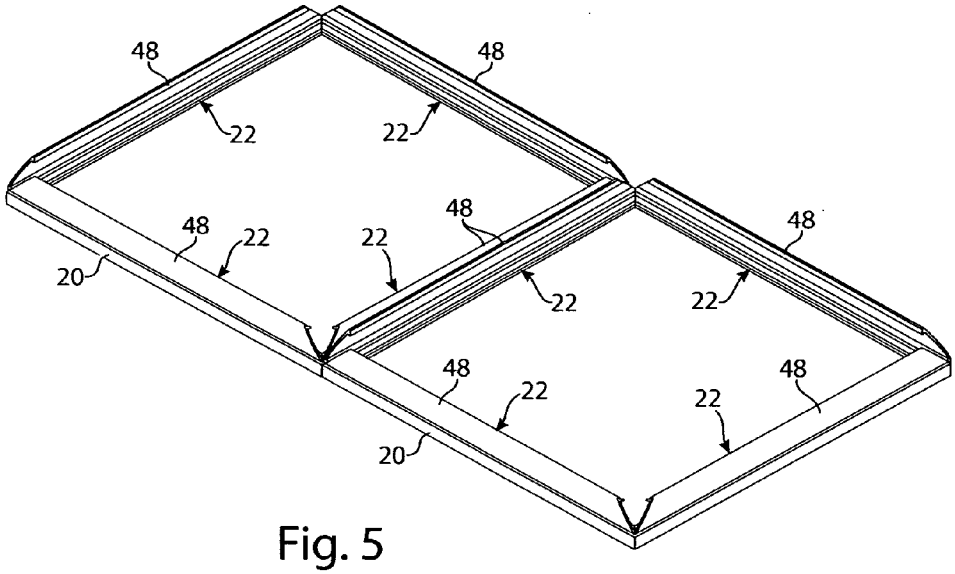
FIG. 5 is a perspective view of a pair of portable frame assemblies in abuttable contact with their individual frame members each shown in the open orientation.
Figure 6:
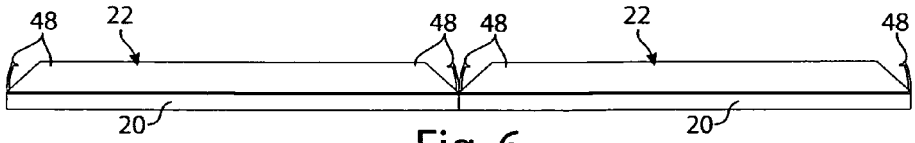
FIG. 6 is an edge view of the pair of abuttable frame assemblies shown in FIG. 5.
Figure 7:
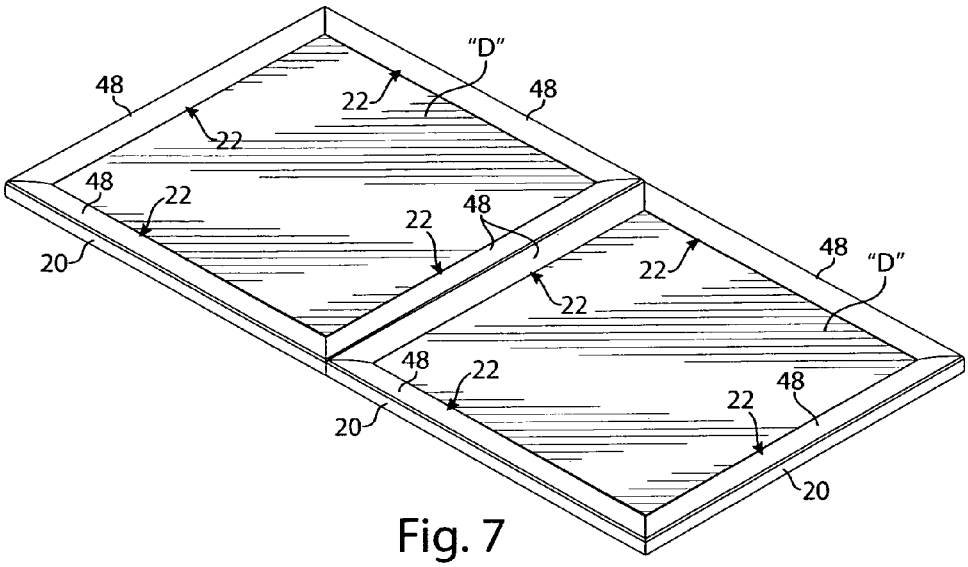
FIG. 7 is a perspective view of the pair of portable frame assemblies similar to that shown in FIG. 5, with their individual frame member shown in a closed orientation.

Referring now to the drawings in detail and particularly to FIGS. 5 and 7, there is shown a pair assemblies of the present invention, which as shown comprises two space saving snap frame assemblies 20 shown in their open display receiving and their closed display-biased orientation respectively. The frame assembly 20 is comprised of multiple space saving, abuttable, snap frame members 22, shown open in FIG. 1, and shown as closed in FIG. 2, connected into a four sided structure, as best represented open in FIGS. 5 and 6, and as closed assemblies in FIGS. 7 and 8.

Figure 1:
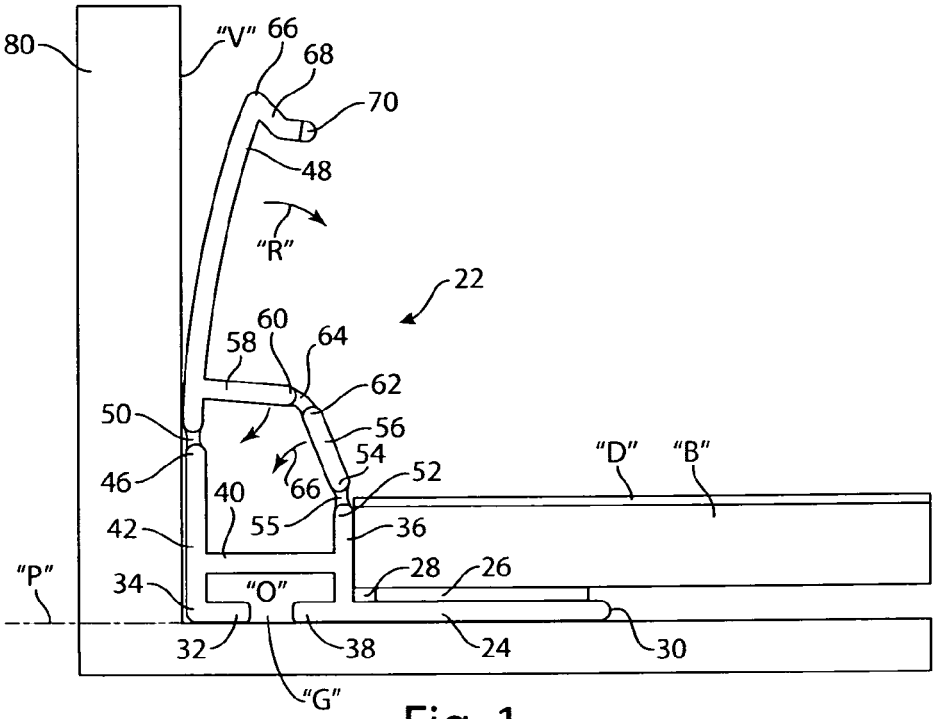
FIG. 1 is an edge view of a frame member in its openmost orientation.
Figure 2:
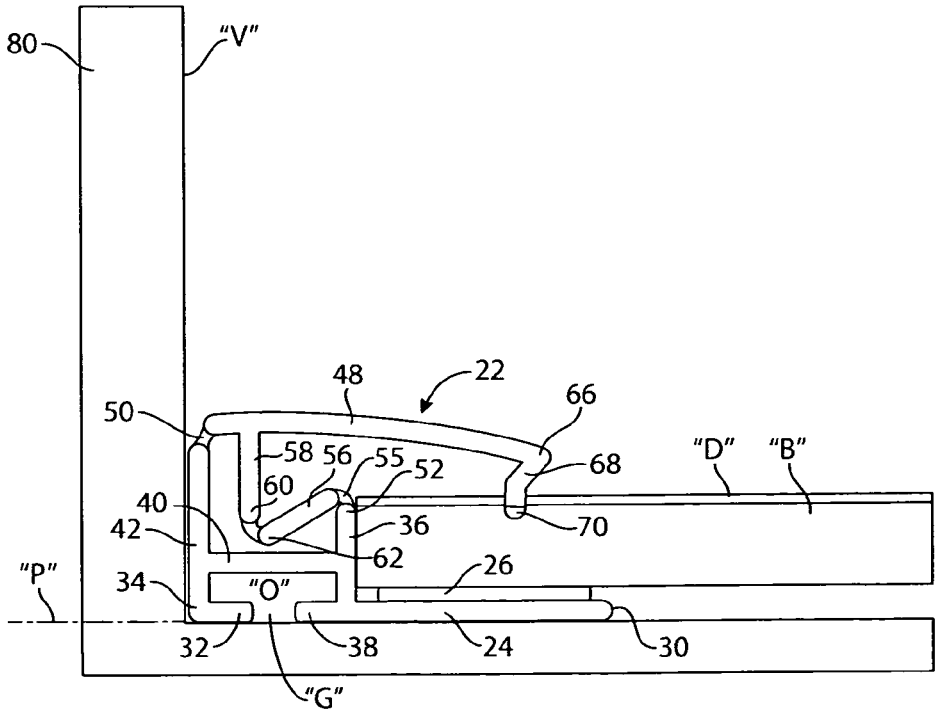
FIG. 2 is an edge view of the frame member shown in FIG. 1 with the elongated "J" shaped cover in a fully closed or biased orientation with respect to the base panel.
Figure 3:
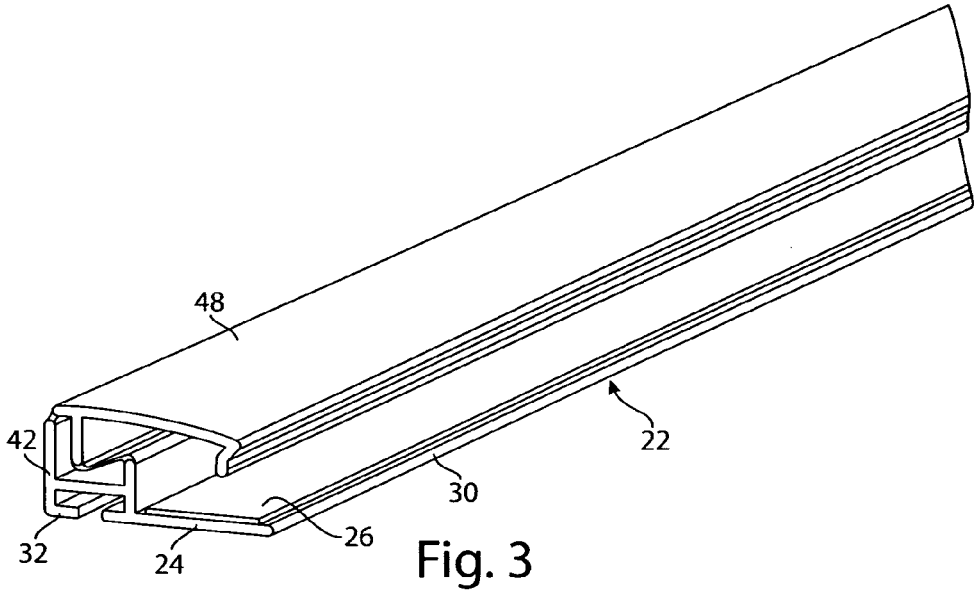
FIG. 3 is a perspective view of the frame member shown in FIG. 1, with miter cuts, in its closed orientation.
Figure 4:
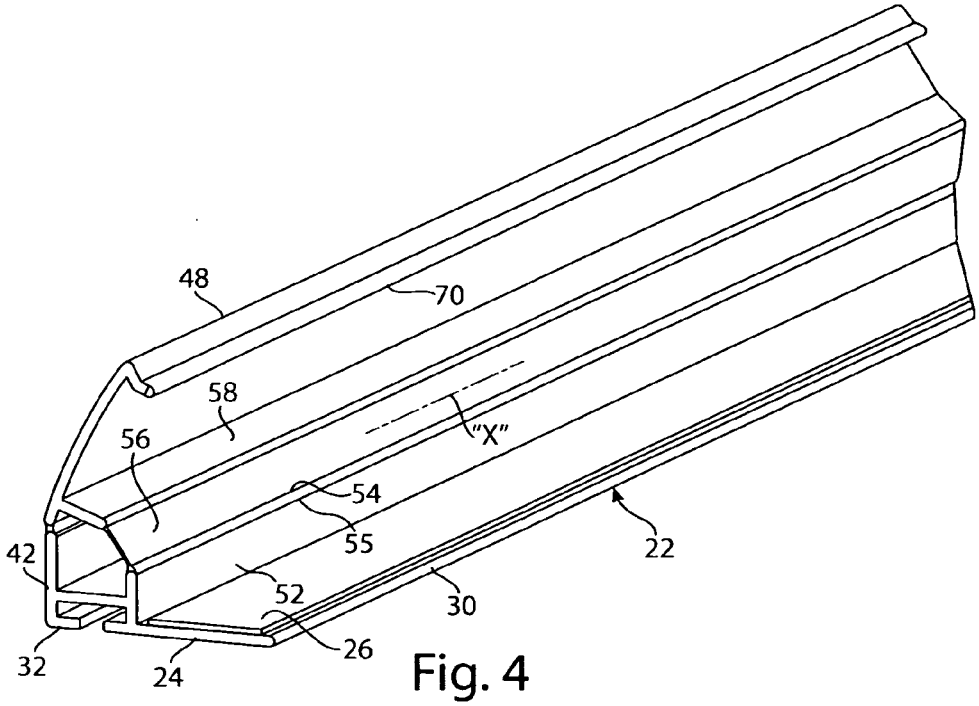
FIG. 4 is a perspective view of the frame member shown in FIG. 3, in an open orientation.

Each abuttable frame member 22, represented in an end view in FIGS. 1, 2, and in a perspective view in FIGS. 3 and 4 comprises an elongated extrusion having an elongated base panel 24 thereon. A thin layer of securement material 26 such as adhesive may be applied to it on an upper side 28 of the base panel 24 during the manufacturing extrusion operation. The elongated base panel 24 includes an elongated distal edge 30 along one elongated side edge thereof, as represented in FIGS. 1-4. The elongated base panel 24 includes a forwardly directed first flange 32 along an elongated proximal edge 34 thereof, shown as "L" shaped on the lower left in FIGS. 1 and 2. An elongated first stationary wall 36 extends at a right angle from the upper side 28 of the elongated base panel 24 and a close spaced-apart distance from an elongated second flange 38. A bridging panel member 40 extends from a midpoint of the first stationary wall 36 rearwardly, to a second stationary wall 42. The second stationary wall 42 and flange 32 are of "L" shape in cross-section, as may be seen in FIGS. 1 and 2, and the forwardly directed first flange 32 faces towards the second flange 38. The second flange 38 and the first flange 32 thus lie in a common plane "P" and are spaced apart so as to define a gap "G" therebetween. An open channel "O" is thus defined between the first flange 32, the second flange 38, and the bridging member 40 extending between the first wall 36 and the second wall 42, as may be seen in FIGS. 1 and 2. The second wall 42 has an elongated upper edge 46 which is unitary with a "J" shaped elongated cover 48. The second wall 46 and the elongated "J" shaped cover 48 are unitarily attached to one another by a hinge means, such as for example, a co-extruded first web 50 of flexible material.

The first wall 36 has an elongated upper edge 52 which is attached unitarily to the lower side 54 of an elongated first hinge leg 56, by a hinge means, such as, for example, an elongated flexible web of material 55. In one preferred embodiment, the elongated first hinge leg 56 may itself be of rigid material, and in a further preferred embodiment, the elongated first leg 56 itself, may be extruded of soft or resilient and flexible material.

The elongated "J" shaped cover 48 has a second or "connecting" leg 58 extending perpendicularly inwardly therefrom as shown in FIGS. 1-4, adjacent to the location of the first web of flexible material 50. The elongated distalmost edge 60 of the second or connecting leg 58 is flexibly connected to the uppermost elongated edge 62 of the first leg 56 by a hinge means such as for example, a commonly extruded flexible web of material 64 unitarily arranged therebetween, as best seen in FIGS. 1 and 2.

The elongated "J" shaped cover 48 has an elongated distalmost edge 66 which has an elongated distal leg 68 extending therefrom. The distal leg 68 has an elongated distalmost edge 70 of for example, a preferably soft gripping material coextruded therewith, as shown in FIGS. 1 and 2.

The elongated "J" shaped cover 48, when it is in its open and "display receiving" orientation, as represented best in FIGS. 1 and 4, is not open any further than the generally vertical plane "V", of the second wall 42 of the frame member 22, the plane "V" of the second wall 42 extending perpendicularly away from the plane "P" of the base panel 24 at the proximalmost or rear edge 34 thereof, as represented in FIGS. 1 and 2.

The backer board "B" may be attached to a layer of securement material 26 applied directly thereto, or onto the upper surface of the base panel 24, thus providing a surface for supporting a planar display "D".

When it is desired to retain some sort of planar display "D" onto the upper side 28 of the backer board "B", as represented in FIGS. 1 and 2, the elongated "J" shaped cover 48 is manually caused to pivot downwardly, or clockwise to the right as indicated by the arrow "R", as shown in FIG. 1, so as to effect the elongated distalmost edge 70 thereon into biased contact with that display member "D" placed onto a backer board "BB", as represented in FIG. 2. During that pivoting motion of the "J" shaped cover downwardly and radially, (clockwise as represented in FIG. 1), it pivots about its elongated axis or first web of flexible material 50, which material extends between the elongated edges of the "J" shaped cover 48 and the upper edge 46 of the second wall 42. The second hinge leg 58 thus is also pivoted in a clockwise orientation, as represented in the end view shown in FIG. 1, inasmuch as it is fixedly attached to the inner side of the "J" shaped cover 48. That second hinge leg 58, being flexibly connected via an elongated flexible web of material 64, to the upper elongated edge 62 of the first hinge leg 56, pivots that first hinge leg 56 counterclockwise (axially about its longitudinal axis "X", as represented in FIG. 4, and as also represented by arrow "CC" in FIG. 1) about its elongated web of flexible material 55, by which it is attached to the upper elongated edge 52 of the first wall 36. Thus, the "J" shaped cover 48 pivots from a generally perpendicular orientation to the base panel 24, as represented in FIG. 1, into an orientation which is generally parallel thereto, as represented in FIG. 2. The second hinge leg 58, is pivoted, from a generally horizontal and parallel orientation with respect to the base panel 24 (as represented in FIG. 1) into an orientation which is perpendicular to the base panel 24 (as represented in FIG. 2). The first hinge leg 56 is pivotable about its elongated flexible web of material 55 to which it is attached to the upper elongated edge 52 of the first wall 36, by about 90°, so as to reside at a generally 8 o'clock orientation, shown in FIG. 2, as opposed to its 11 o'clock orientation, as represented in FIG. 1.

Thus the elongated intermediate second web of flexible material 64 is snapped into an orientation closer to the bridging member 40 between the first wall 36 and the second wall 42, as represented in FIG. 4, from a position of being spaced further away, as represented in FIG. 1. That snapping orientation effects the biasing of the elongated distalmost edge 70 of the "J" shaped cover 48 onto a display panel "D" between that elongated distalmost edge 70 and the base panel 24, or a backer board "B" thereon, as may be seen in FIG. 2.

Figure 9:
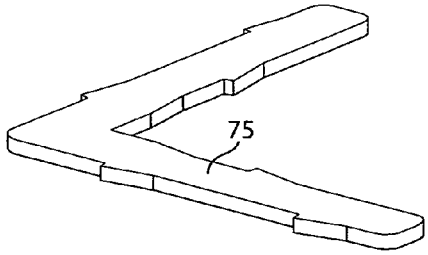
FIG. 9 is a perspective view of an "L" shaped corner bracket utilized to connect adjacent frame members into a 90° configuration thereafter.

The elongated open channel "O" between the first flange 32 and the second flange 38 and the bridge 40 extending between the elongated first wall 36 and the second wall 42 defines a receiving space for an "L" shaped corner bracket 75, shown in FIG. 9, so as to permit multiple frame members 22 to be attached at their corners 77 to provide a rectilinear frame assembly/ies 20 therearound, if desired, as represented in FIGS. 5 and 6 in the frame assembly display-receiving orientation, and the frame assembly 20 in the frame assembly display orientation, represented in FIG. 7.

An abuttable frame member 22 is shown in FIG. 1, in close abutting contact with an exemplary fixture 80, wherein the elongated cover 48 is in its openmost orientation. This presentation represents the ability of the elongated cover of 48 to be fully open while in this embodiment, extending no further than in close planar alignment with the vertical plane "V" of the of the second wall 42, which could also comprise the plane of the inside surface of the fixture 80, while the cover 48 could, if desired, and while not in abutting contact with another structure, be spread open beyond the plane "V". That movable frame member 22 is shown in its closed orientation in FIG. 2 wherein its second wall 42 is still in abuttable contact with an adjacent fixture 80. FIG. 5, shows a plurality of frame members 22 put together as a pair of frame assemblies 20 in abuttable contact with one another in a perspective representation thereof FIG. 6 shows those frame assemblies of FIG. 5, in an edge view, wherein the elongated covers 48 are shown open, and back-to-back with one another, and in non-interfering abuttable contact therewith.

Figure 8:
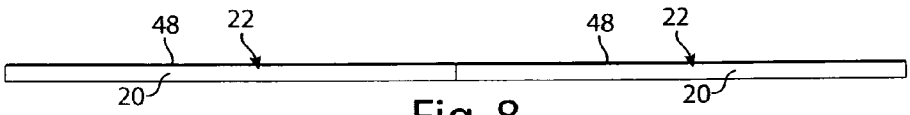
FIG. 8 is an edge view of the pair of the abuttable frame assemblies shown in FIG. 7.

FIG. 7 represents those two frame assemblies 20 shown in perspective view in FIG. 5, wherein the elongated covers 48 of each frame assembly 20 are now closed so as to retain a display piece "D". FIG. 8 shows those two frame members 20 from FIG. 7, in edgewise representation, thus showing the space-saving abuttability of the frame members 22 of the present invention.

We claim:

1. An elongated extruded fixture abuttable snap frame arrangement for biasably removably capturing a display graphic for support and display thereof comprising:

an elongated extruded base panel;

an elongated first wall arranged perpendicular to the base panel;

an elongated proximalmost fixture abuttable second wall;

an elongated cover flexibly attached by an elongated flexible web connected to the fixture abuttable second wall, the elongated cover also having an elongated connecting leg extending inwardly therefrom; and an elongated first hinge leg flexibly connected by an elongated flexible web, to a distal edge of the elongated connecting leg extending from the elongated cover, the elongated first hinge leg also flexibly connected by an elongated flexible web, to an upper edge of the first wall, where openable movement of the elongated cover is limited to alignment with a rear plane-of-the-second wall by the elongated first hinge leg, to permit the elongated cover to be fully opened and still be free of interference with an abutting fixture.

2. The snap frame arrangement as recited in claim 1, wherein the elongated second wall and the elongated cover are generally parallel when the elongated cover is in a full open orientation.

3. The snap frame arrangement as recited in claim 1 wherein the elongated first wall and the elongated second wall are connected by an elongated bridge member.

4. The snap frame arrangement as recited in claim 1, wherein the elongated first hinge leg is caused to rotate towards the plane of the elongated base panel when the elongated cover is rotated towards the elongated base panel.

5. The snap frame arrangement as recited in claim 1, wherein the elongated first wall has an elongated first flange thereadjacent and the elongated second wall has an elongated second flange thereadjacent, the elongated first and second flanges being spaced apart in a common plane with the elongated base panel.

6. The snap frame arrangement as recited in claim 1, wherein the elongated cover has an elongated "J" shaped distal leg thereon.

7. The snap frame arrangement as recited in claim 6, wherein the elongated "J" shaped distal leg has an elongated, display-engaging, soft distal edge thereon.

8. The snap frame arrangement as recited in claim 1, wherein the elongated first hinge leg pivots away from the plane of the elongated base panel when the elongated cover is pivoted upwardly away from the elongated base panel.

9. The snap frame arrangement as recited in claim 1, wherein the elongated base panel has an elongated layer of adhesive deposited on at least one side thereof.

10. The snap frame arrangement as recited in claim 1, wherein the elongated cover and the elongated base panel are in general parallel alignment when the cover is in its closed orientation.

11. The snap frame arrangement as recited in claim 1, wherein the elongated cover is limited to a pivot of approximately 90 degrees about the elongated flexible web to which it is connected to the elongated second wall.

12. The snap frame arrangement as recited in claim 1, wherein the inwardly extending elongated connecting leg attached to the elongated cover effects a snap bias onto the elongated first hinge leg effecting a snap rotation thereof.

13. The snap frame arrangement as recited in claim 1, wherein the elongated second wall and the elongated cover are arranged to lie generally in the same plane when the elongated cover is in a full open orientation.

14. The snap frame arrangement as recited in claim 1, wherein the elongated cover extends beyond the plane of the second wall when the elongated cover is in a full open orientation.

15. A method of retaining a display panel within an openable and closable frame member, with the frame member being in abuttable contact with a fixture, comprising:

extruding an elongated base panel having an upper surface with a first wall extending perpendicularly therefrom, and a second wall connected to and spaced apart from the first wall, the second wall having a rearmost vertical plane;

co-extruding a cover so as to be flexibly attached to the second wall by a flexible web, the first wall and the cover being connected to one another by a flexibly attached first leg connected to the first wall and also to a second leg connected to an inside portion of the cover, the cover in its openmost position extending no further open than the rearmost vertical plane of the second wall;

closing the cover against a display panel by pivoting the cover about the flexible web by which it is attached to the second wall, by rotating the first leg and the second leg in directions counter to one another.

16. The method as recited in claim 15, wherein the first wall and the second wall are connected to one another by a bridging member extending there between.

17. The method as recited in claim 15, wherein the first leg is connected to the first wall by a flexible web extending therebetween, and wherein the first leg is also connected to the second leg by a flexible web extending therebetween.

18. The method as recited in claim 15, including:

biasing a distal edge of the cover against the display panel during the counter rotation of the first leg with respect to the second leg.

19. The method as recited in claim 15, including:

rotating the first leg between a pair of spaced apart flexible webs so as to effect opening or closing of the cover away from or onto a display panel disposed on the base panel.

* * * * *